US009579010B2

(12) United States Patent
Shewmaker

(10) Patent No.: US 9,579,010 B2
(45) Date of Patent: Feb. 28, 2017

(54) DISHWASHER APPLIANCE

(71) Applicant: General Electric Company, Schenectady, NY (US)

(72) Inventor: Darrell W. Shewmaker, Georgetown, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 14/736,533

(22) Filed: Jun. 11, 2015

(65) Prior Publication Data

US 2016/0360946 A1 Dec. 15, 2016

(51) Int. Cl.
*A47L 15/50* (2006.01)

(52) U.S. Cl.
CPC ..... *A47L 15/507* (2013.01)

(58) Field of Classification Search
CPC ..... A47L 15/507
USPC ..... 134/56 D, 57 D, 58 D, 133
See application file for complete search history.

(56) References Cited

U.S. PATENT DOCUMENTS

| | | | | |
|---|---|---|---|---|
| 8,590,991 | B2 | 11/2013 | Radusin | |
| 8,906,167 | B2 | 12/2014 | Baldwin et al. | |
| 2006/0250058 | A1* | 11/2006 | Stevens | A47L 15/502 312/311 |
| 2008/0067905 | A1 | 3/2008 | Guiles | |
| 2011/0200278 | A1* | 8/2011 | Radusin | A47B 88/0418 384/49 |
| 2013/0247944 | A1* | 9/2013 | Fischer | A47L 15/50 134/164 |

* cited by examiner

*Primary Examiner* — Michael Barr
*Assistant Examiner* — Levon J Shahinian
(74) *Attorney, Agent, or Firm* — Dority & Manning, P.A.

(57) ABSTRACT

A dishwasher appliance includes a rack assembly. A bracket of the rack assembly has a post and a support projection that defines a plurality of slots. The post of the bracket extends through a tub of the dishwasher appliance, and a sleeve engages the post such that the sleeve hinders the post from retracting through the tub. A slide rail is mounted on the support projection of the bracket.

20 Claims, 9 Drawing Sheets

DISHWASHER APPLIANCE

FIELD OF THE INVENTION

The present subject matter relates generally to dishwasher appliances and methods for mounting slide rails in the same.

BACKGROUND OF THE INVENTION

A dishwasher appliance is typically provided with one or more rack assemblies into which various articles may be loaded for cleaning. The rack assemblies may include features such as, e.g., tines that hold and orient the articles to receive sprays of wash and rinse fluids during the cleaning process. The articles to be cleaned may include a variety of dishes, cooking utensils, silverware, and other items.

Certain dishwasher appliances include rack assemblies that are mounted to tubs of the dishwasher appliances with wheel and rack systems. The wheel can roll within a slide track in order to permit movement of the rack assembly into and out of the tub. Wheel and rack systems have certain drawbacks. For example, inconsistent rotation of the wheel within the rack can provide inconsistent rack assembly motion. As another example, wheel and rack systems can require relatively high insertion and/or retraction forces to move the rack assembly. In addition, the rack is generally mounted to the tub with welding or adhesive such that removing the rack from the tub is difficult.

Slides rails can provide smooth rack assembly motion. However, slide rails can be difficult to mount to the tub. In particular, top portions of the tub can include curved surfaces. Mounting a slide rail at the top portion of the tub can be difficult due to such curved surfaces.

Accordingly, a dishwasher appliance with features for assisting with smooth rack assembly motion would be useful. In particular, a dishwasher appliance with features for providing smooth rack assembly motion for a rack assembly at a top portion of the tub would be useful. In addition, a dishwasher appliance with features for assisting an installer with mounting a rack assembly within the dishwasher appliance would be useful.

BRIEF DESCRIPTION OF THE INVENTION

The present subject matter provides a dishwasher appliance that includes a rack assembly. A bracket of the rack assembly has a post and a support projection that defines a plurality of slots. The post of the bracket extends through a tub of the dishwasher appliance, and a sleeve engages the post such that the sleeve hinders the post from retracting through the tub. A slide rail is mounted on the support projection of the bracket. Additional aspects and advantages of the invention will be set forth in part in the following description, or may be apparent from the description, or may be learned through practice of the invention.

In a first exemplary embodiment, a dishwasher appliance is provided. The dishwasher appliance includes a rack assembly and a tub that defines a wash chamber. The rack assembly includes a bracket positioned within the wash chamber of the tub. The bracket has a support projection that defines a plurality of slots. A post is mounted to the bracket, and the post extends through the tub. A sleeve is positioned opposite the bracket on the tub. The sleeve engages the post such that the sleeve hinders the post from retracting through the tub. A slide rail is positioned within the wash chamber and is mounted on the support projection of the bracket.

In a second exemplary embodiment, a dishwasher appliance is provided. The dishwasher appliance includes a tub that defines a wash chamber. A rack assembly includes a pair of brackets positioned within the wash chamber of the tub. Each bracket of the pair of brackets has a support projection that defines a plurality of slots. A pair of posts extends through the tub. Each post of the pair of posts is mounted to a respective bracket of the pair of brackets. A pair of sleeves is positioned on the tub. Each sleeve of the pair of sleeves is positioned opposite a respective bracket of the pair of brackets about the tub. Each sleeve of the pair of sleeves engages a respective post of the pair of post such that each sleeve hinders the respective post from retracting through the tub. A slide rail is positioned within the wash chamber and is mounted on the support projection of each bracket of the pair of brackets.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
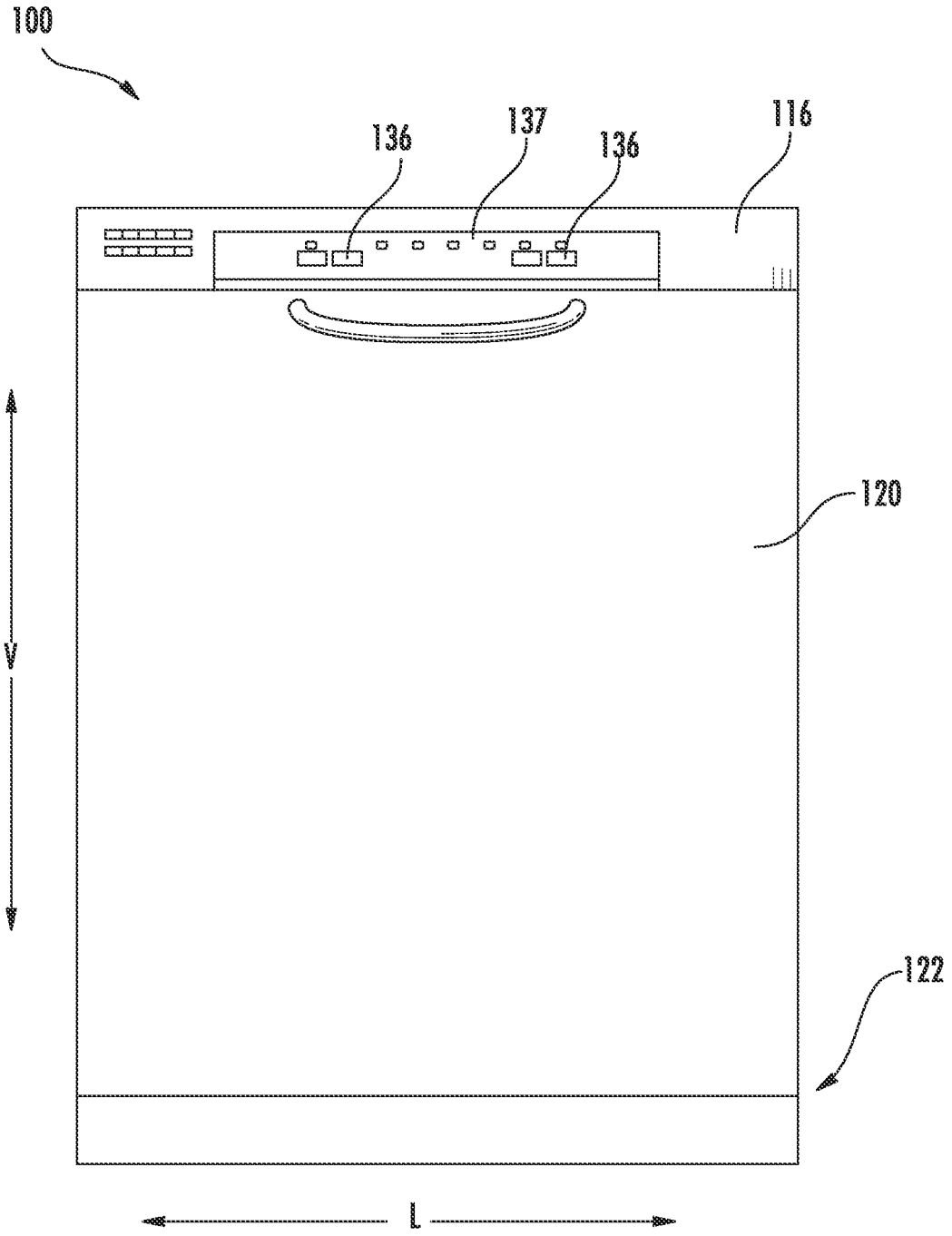
FIG. 1 provides a front, elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
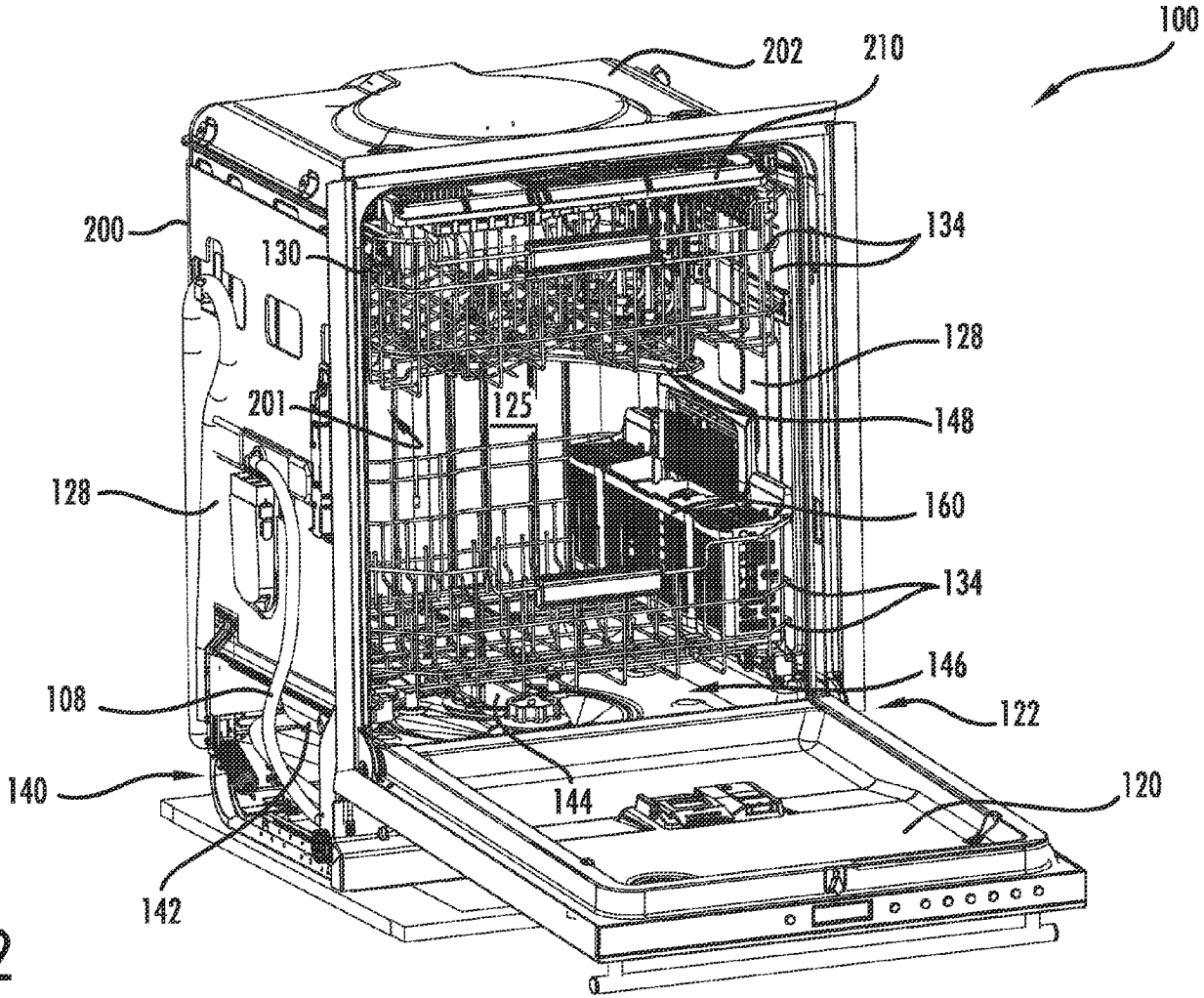
FIG. 2 provides a perspective view of the exemplary dishwasher appliance of FIG. 1 with a door of the exemplary dishwasher appliance shown in an open position to reveal a wash chamber of the exemplary dishwasher appliance.

FIG. 1 provides a front, elevation view of a dishwasher appliance 100 according to an exemplary embodiment of the present subject matter. FIG. 2 provides a perspective view of dishwasher appliance 100 with a door 120 of dishwasher appliance 100 shown in an open position to reveal a wash chamber or compartment 201 of dishwasher appliance 100. Dishwasher appliance 100 defines a vertical direction V, a lateral direction L, and a transverse direction T. Vertical direction V, lateral direction L, and transverse direction T are mutually perpendicular and form an orthogonal direction system.

Dishwasher appliance 100 includes a tub 200 that defines wash chamber 201. Tub 200 has a pair of side walls 128, a back wall 125, and a top wall 202 that assist with defining wash chamber 201. Side walls 128 are spaced apart from each other, e.g., along the lateral direction L. Back wall 125 and top wall 202 extend between and connect side walls 128, e.g., along the lateral direction L. Tub 200 also includes door 120 hinged at its bottom 122 for movement between a normally closed configuration (shown in FIG. 1) in which wash chamber 201 is sealed shut, e.g., for washing operation, and an open configuration (shown in FIGS. 2 and 3) for loading and unloading of articles from dishwasher appliance 100.

Turning to FIG. 2, tub side walls 128 accommodate middle and lower rack assemblies 130 and 132. Each of the middle and lower racks assemblies 130 and 132 is fabricated from lattice structures that include a plurality of wires or elongated members 134. Dishwasher appliance 100 also includes an upper rack assembly 210 positioned above middle and lower racks assemblies 130 and 132, e.g., along the vertical direction V, at a top portion of wash chamber 201. Each rack assembly 130, 132 and 210 is adapted for movement between an extended loading position (not shown) in which the rack assembly is substantially positioned outside the wash chamber 201, and a retracted position (shown in FIGS. 1 and 2) in which the rack assembly is located inside the wash chamber 201.

Dishwasher appliance 100 includes a lower spray assembly 144 that is mounted within a lower region 146 of the wash chamber 201 and above a tub sump portion 142 so as to be in relatively close proximity to the lower rack assembly 132. A mid-level spray assembly 148 is located in an upper region of the wash chamber 201 and may be located in close proximity to middle rack assembly 130. Additionally, an upper spray assembly (not shown) may be located above the upper rack assembly 210 and mounted to top wall 202 of tub 200.

The lower and mid-level spray assemblies 144 and 148 and the upper spray assembly are fed by a pump (not shown) for circulating water and wash fluid (e.g., detergent, water, and/or rinse aid) in the tub 200. The pump is located in a machinery compartment 140 located below the bottom sump portion 142 of the tub 200, as generally recognized in the art. A conduit or circulation piping 108 directs water and/or wash fluid from the pump to lower spray assembly 144 and mid-level spray assembly 148.

Each spray assembly includes an arrangement of discharge ports or orifices for directing wash fluid onto dishes or other articles located in the middle and lower rack assemblies 130, 132, silverware basket 160 and upper rack assembly 210. Lower spray assembly 144 is rotatably mounted in wash chamber 201. Accordingly, the arrangement of the discharge ports on lower spray assembly 144 may provide a rotational force by virtue of washing fluid flowing through the discharge ports. The resultant rotation of the lower spray assembly 144 can provide coverage of dishes and other dishwasher contents with a washing spray.

The dishwasher appliance 100 is further equipped with a controller 137 to regulate operation of the dishwasher appliance 100. Controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. Alternatively, controller 137 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 137 may be positioned in a variety of locations throughout dishwasher appliance 100. In the illustrated exemplary embodiment, controller 137 is located within a control panel 116 of door 120. In alternative exemplary embodiments, controller 116 may be positioned beneath tub 200 or at any other suitable location on dishwasher appliance 100. Typically, controller 137 includes a user interface panel 136 through which a user may select various operational features and modes and monitor progress of the dishwasher appliance 100. In one exemplary embodiment, user interface 136 represents a general purpose I/O ("GPIO") device or functional block. In another exemplary embodiment, user interface 136 includes input components, such as one or more of a variety of electrical, mechanical or electro-mechanical input devices including rotary dials, push buttons, and touch pads. User interface 136 may include a display component, such as a digital or analog display device designed to provide operational feedback to a user.

It should be appreciated that the present subject matter is not limited to any particular style, model, or other configuration of dishwasher appliance and that dishwasher appliance 100 depicted in FIGS. 1 and 2 is provided for illustrative purposes only. For example, the present subject matter may be used in dishwasher appliances having other rack configurations or spray assembly arrangements.

Figure 3:
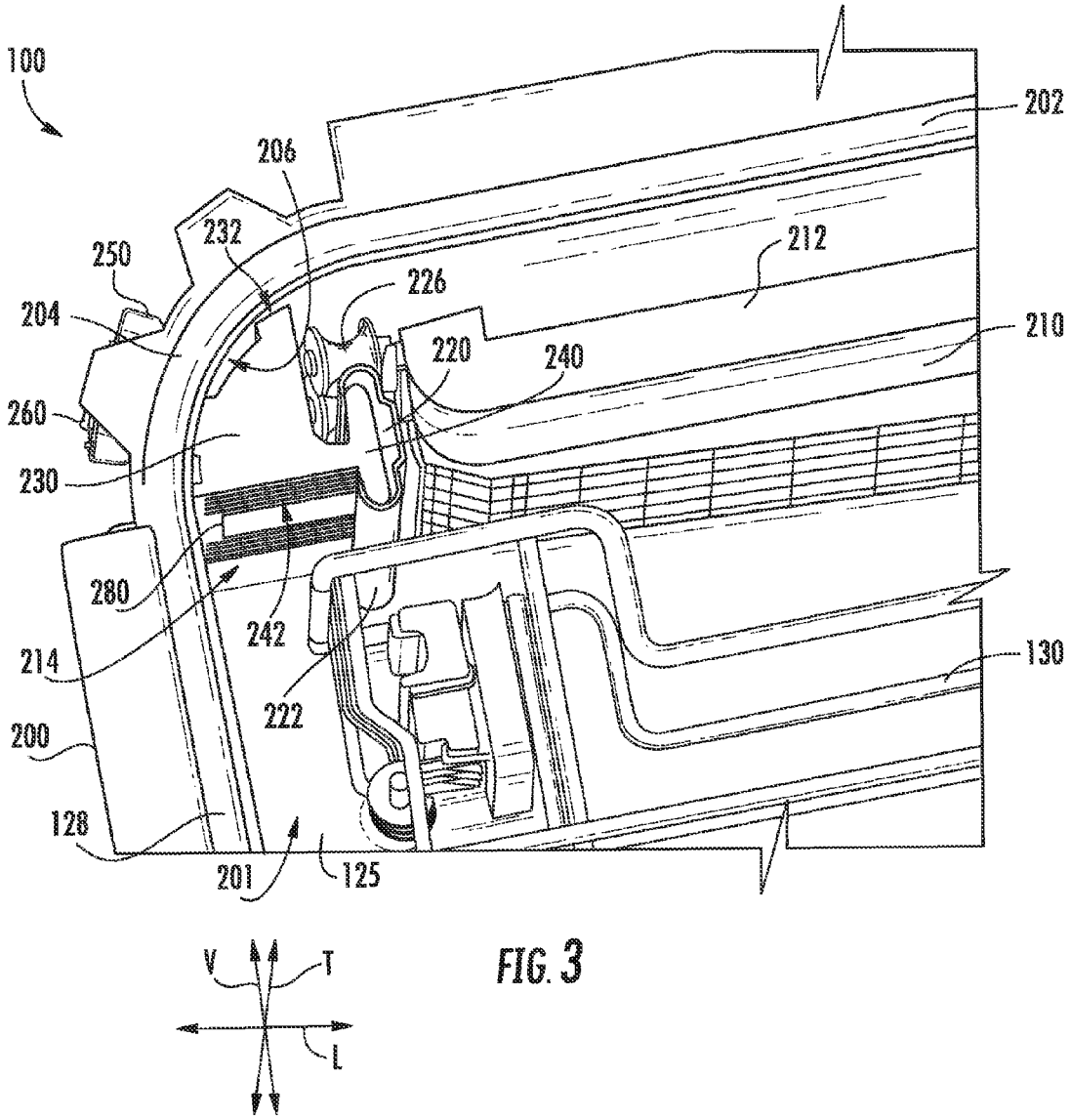
FIG. 3 provides a partial, front perspective view of a tub and a rack assembly of the exemplary dishwasher appliance of FIG. 1.
Figure 4:
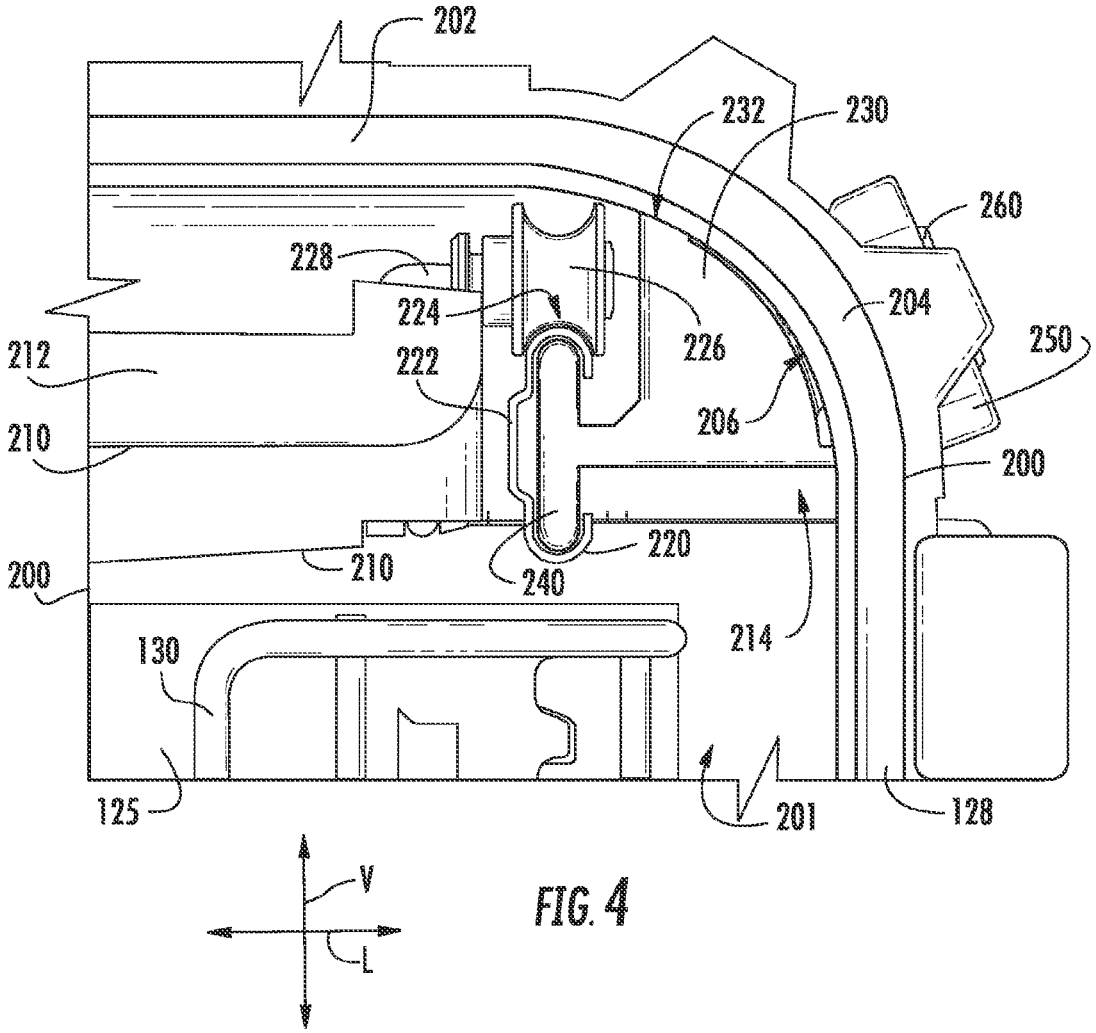
FIG. 4 provides a partial, front elevation view of the tub and rack assembly of the exemplary dishwasher appliance of FIG. 1.

FIG. 3 provides a partial, front perspective view of tub 200 and upper rack assembly 210 of dishwasher appliance 100. FIG. 4 provides a partial, front elevation view of tub 200 and rack assembly 210 of dishwasher appliance 100. As discussed in greater detail below, rack assembly 210 includes features for assisting with mounting rack assembly 210 to tub 200 within wash chamber 201 of tub 200. Various features of tub 200, rack assembly 210 and components for mounting rack assembly 210 to tub 200 may be constructed in accordance with U.S. patent application Ser. No. 14/149,877 of Shaffer et al. entitled "A DISHWASHER APPLIANCE AND A METHOD FOR MOUNTING A SLIDE RAIL IN A DISHWASHER APPLIANCE" filed Jan. 8, 2014, which is hereby incorporated by reference in its entirety for all purposes. In addition, it should be understood that, while described in greater detail below in the context of dishwasher appliance 100, tub 200 and/or rack assembly 210 may be used in any other suitable dishwasher appliance, in alternative exemplary embodiments.

As may be seen in FIGS. 3 and 4, tub 200 defines wash chamber 201 and includes a top wall 202 and transition portions 204. Transition portions 204 correspond to portions of tub 200 that extend between top wall 202 and other portions of tub 200, such as side walls 128 and/or back wall 125, e.g., along the vertical direction V. Transition portions 204 include curved inner surfaces 206. In certain exemplary embodiments, tub 200 is constructed of or with a molded material, such as plastic, or a stamped material, such as stainless steel. Thus, top wall 202 and transition portions 204 may be integrally formed of a single piece of molded plastic or stamped metal.

Rack assembly 210 includes silverware baskets 212 and mounting assembly 214. Silverware baskets 212 are configured for receiving and supporting silverware therein during operation of an associated dishwasher appliance. Mounting assembly 214 assists with mounting silverware baskets 212 to tub 200. Thus, mounting assembly 214 can assist with supporting silverware baskets 212 within wash chamber 201 of tub 200.

Figure 5:
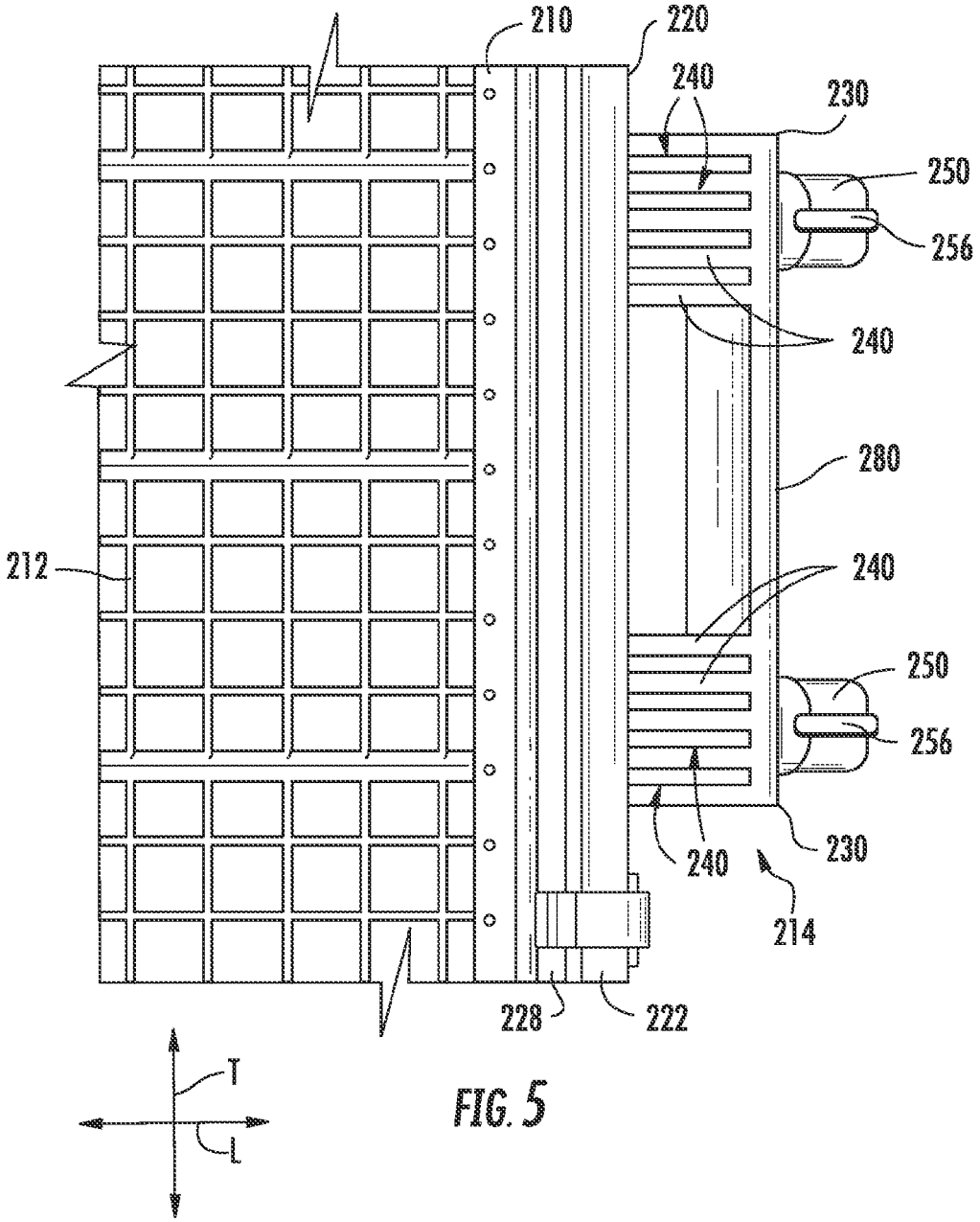
FIG. 5 provides a partial plan view of the rack assembly of the exemplary dishwasher appliance of FIG. 1.
Figure 6:
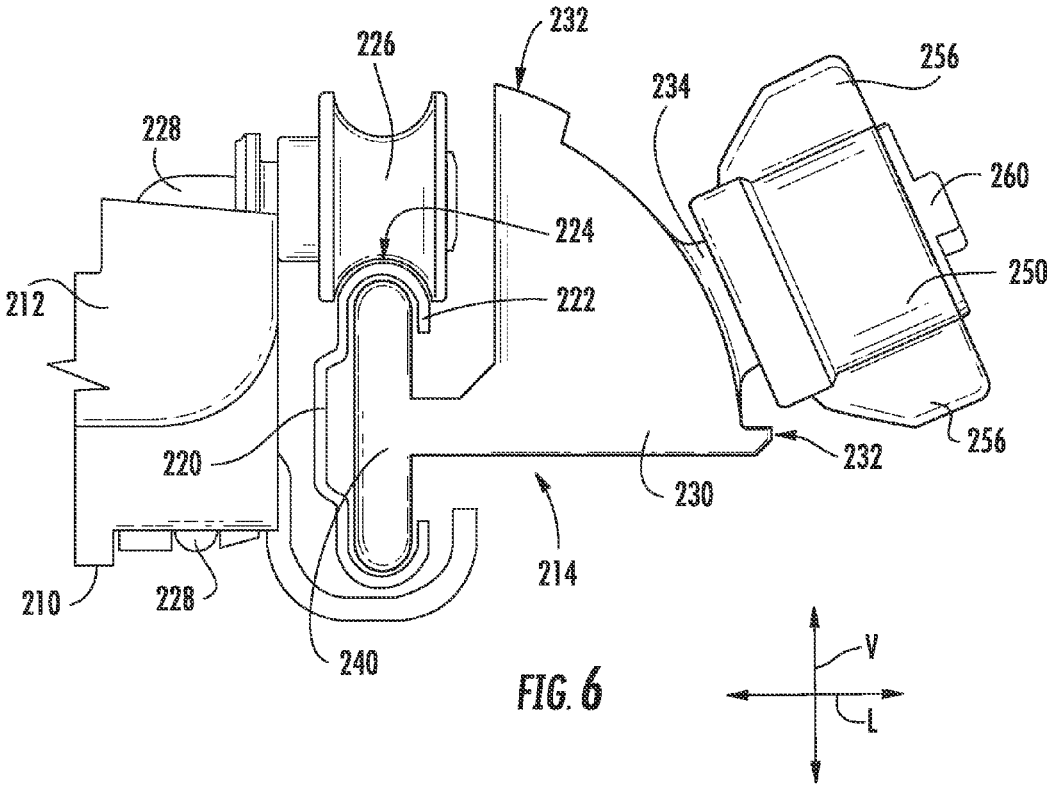
FIG. 6 provides a partial elevation view of the rack assembly of the exemplary dishwasher appliance of FIG. 1.

FIG. 5 provides a partial plan view of rack assembly 210. FIG. 6 provides a partial elevation view of rack assembly 210. As may be seen in FIGS. 5 and 6, mounting assembly 214 includes a slide rail 220 and at least one bracket 230. Brackets 230 are mounted to tub 200 and are positioned within wash chamber 201 of tub 200. Slide rail 220 is also positioned within wash chamber 201 of tub 200. In particular, slide rail 220 is slidably mounted to brackets 230 within wash chamber 201 of tub 200, as discussed in greater detail below.

As discussed above, tub 200 defines curved inner surface 206. As may be seen in FIGS. 3 and 4, brackets 230 may be positioned in wash chamber 201 at or on curved inner surface 206 of tub 200. In particular, brackets 230 define a curved outer surface 232. Curved outer surface 232 of brackets 230 are complementary to curved inner surface 206 of tub 200. In particular, a shape or profile of curved outer surface 232 of brackets 230 can substantially match or fit curved inner surface 206 of tub 200, e.g., in a plane that is perpendicular to the transverse direction T. Curved outer surface 232 of brackets 230 may be positioned on or at curved inner surface 206 of tub 200.

Figure 7:
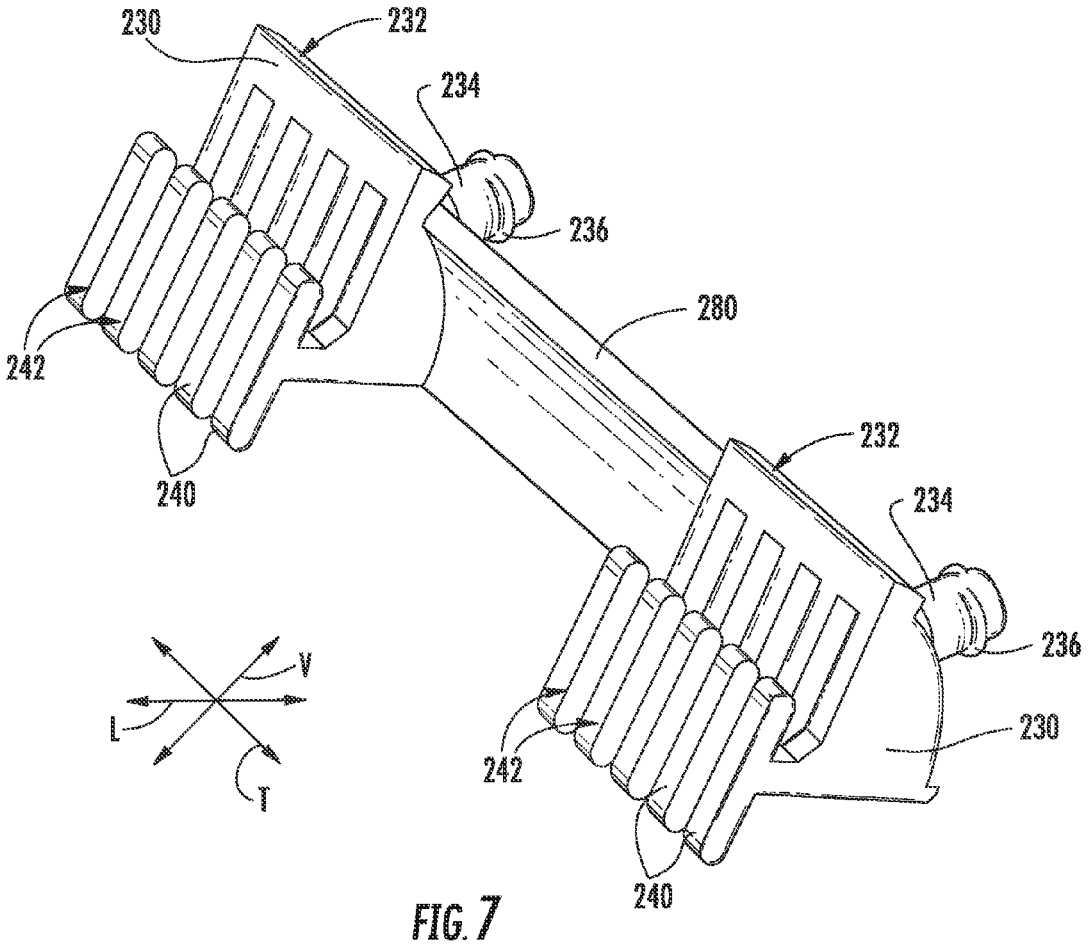
FIG. 7 provides a perspective view of brackets of the rack assembly of FIG. 5.
Figure 8:
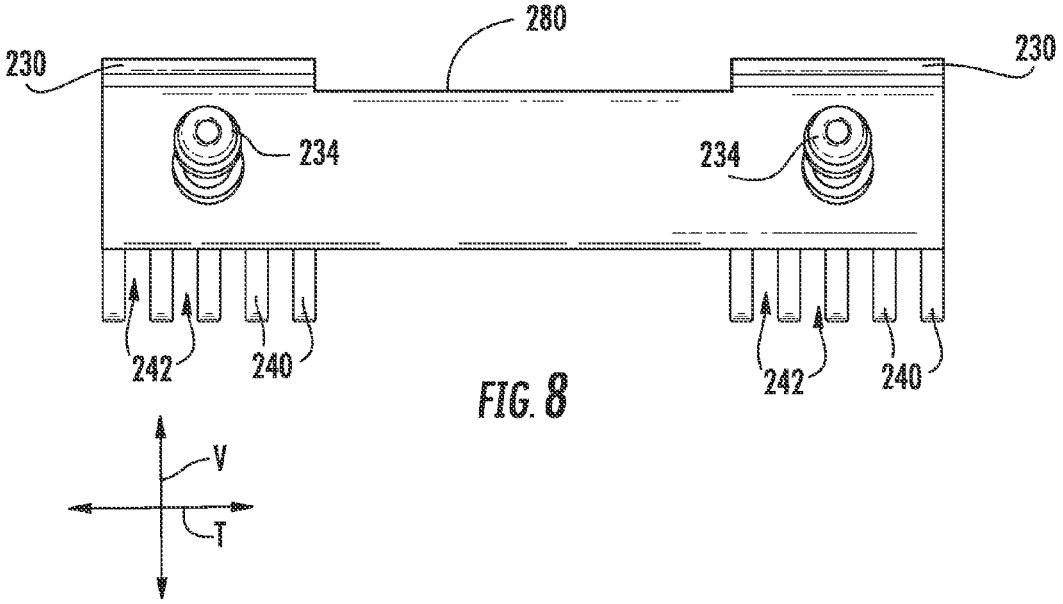
FIGS. 8, 9 and 10 provide various elevation views of the brackets of FIG. 7.
Figure 9:
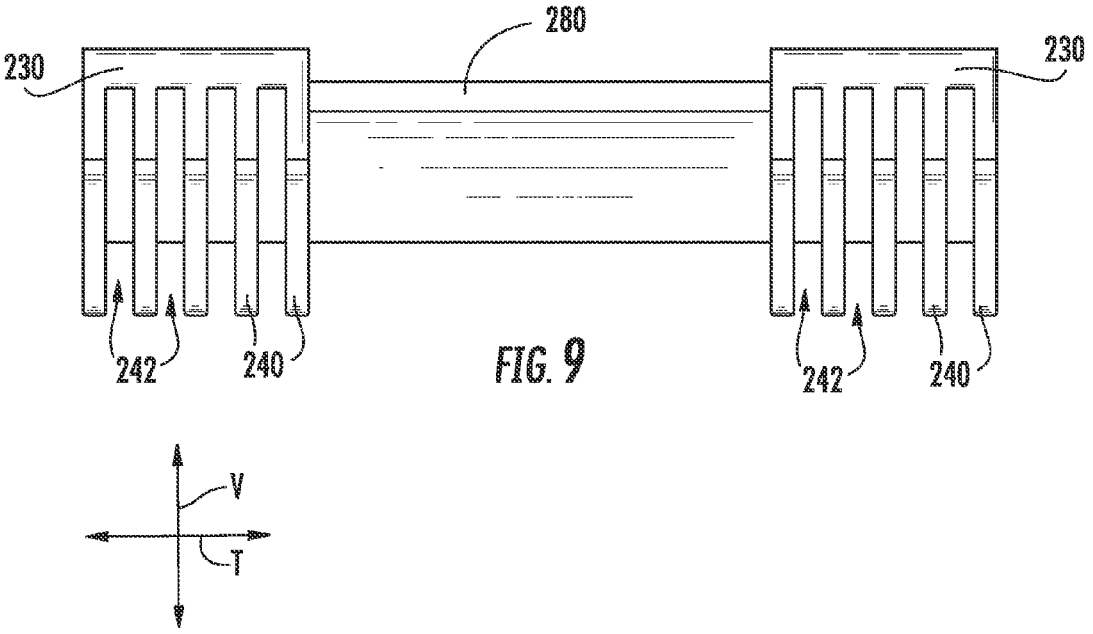
Figure 10:
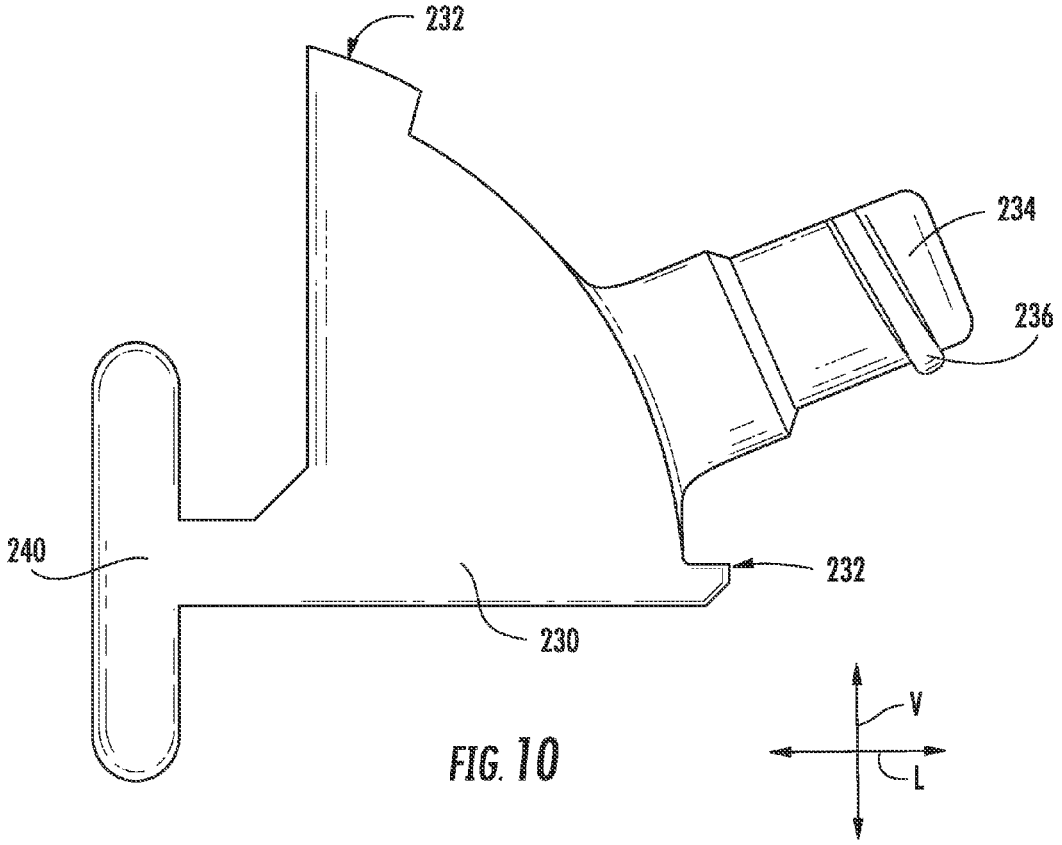

FIG. 7 provides a perspective view of brackets 230 of rack assembly 210. FIGS. 8, 9 and 10 provide various elevation views of brackets 230. As may be seen in FIGS. 7, 8, 9 and 10, each bracket of brackets 230 has at least one support projection 240. As may be seen in FIG. 10, each support projection 240 may have a stadium shape or cross-section, e.g., in a plane that is perpendicular to the transverse direction T. In alternative exemplary embodiments, each support projection 240 may have any other suitable shape or cross-section, e.g., in a plane that is perpendicular to the transverse direction T, such an oval shape or cross-section, an elliptical shape or cross-section, a rounded rectangular shape or cross-section, etc. As discussed in greater detail below, support projections 240 of brackets 230 assist with slidably mounting slide rail 220 to brackets 230.

Each support projection 240 also defines a plurality of slots 242. Slots 242 may be spaced apart from each other or distributed, e.g., along the transverse direction T. Slots 242 may also extend, e.g., along the vertical direction V, along a height of each support projection 240. In addition, slots 242 may extend from support projections 240 into other portions of brackets 230, e.g., along the lateral direction L, as shown in FIGS. 7 and 9.

Slots 242 may also be sized for permitting food particles to pass through brackets 230 during operation of the dishwasher appliance 100. Thus, slots 242 may have a width along at least one of the lateral direction L or the transverse direction T such that food particles disposed within water may flow downwardly through support projections 240 of brackets 230 and/or other portions of brackets 230 along the vertical direction V via slots 242. In such a manner, debris accumulation on slide rails 220 and/or brackets 230 may be limited or hindered by slots 242. Slots 242 formed on support projections 240 may also reduce friction between slide rail 220 and support projections 240 by reducing the contact surface area between slide rail 220 and support projections 240, e.g., such that slide rail 220 slides more easily on support projections 240, as discussed in greater detail below.

Any suitable number of slots 242 may be formed on each support projection 240. For example, slots 242 may include at least two slots, at least three slots, at least four slots, at least five, slots, at least six slots, etc. Slots 242 may also be uniformly spaced apart from one another or distributed, e.g., along the transverse direction T.

Slide rail 220 is positioned within wash chamber 201 of tub 200 and is mounted or received on support projections 240 of brackets 230. Slide rail 220 is moveable or slidable on supports projections 242, e.g., along the transverse direction T. However, supports projections 242 may hinder or prevent movement of slide rail 220 along other directions, such as the vertical direction V and/or the lateral direction L. Thus, supports projections 242 may permit movement of slide rail 220 along only the transverse direction T when slide rail 220 is received on support projections 240 of brackets 230.

As may be seen in FIGS. 5 and 6, slide rail 220 may include a C-shaped channel 222 received on support projections 240. Thus, support projections 240 may be received within C-shaped channel 222, and support projections 240 may have a shape or cross-section, e.g., in a plane that is perpendicular to the transverse direction T, that is complementary to an inner surface of C-shaped channel 222. The inner surface of C-shaped channel 222 may slide on an outer surface of support projections 240, e.g., when C-shaped channel 222 moves along the transverse direction T relative to support projections 240.

Rack assembly 210 also includes a frame 228 (e.g., formed of bent metal wire) and a plurality of rollers 226. Frame 228 supports silverware baskets 212, e.g., and is positioned below silverware baskets 212 along the vertical direction V. Thus, silverware baskets 212 may rest on and/or be mounted to frame 228. Rollers 226 are positioned on C-shaped channel 222, e.g., on an upper surface 224 of C-shaped channel 222, and rollers 226 are also rotatably mounted to frame 228. Thus, rollers 226 are configured for supporting frame 228 on C-shaped channel 222 and for rolling on the upper surface 224 of C-shaped channel 222 when frame 228 moves relative to C-shaped channel 222, e.g., along the transverse direction T. As will be understood by those skilled in the art, an extension of C-shaped channel 222 on support projections 240 along the transverse direction T may be limited, and rollers 226 may permit additional extension of silverware baskets 212 from wash chamber 201 of tub 200 by permitting frame 228 to move relative to C-shaped channel 222 along the transverse direction T. As an example, when a user of dishwasher appliance 100 pulls on silverware baskets 212 or frame 228, rollers 226 may roll on upper surface 224 of C-shaped channel 222, until rollers 226 are at an end of C-shaped channel 222. At such point, C-shaped channel 222 may begin to slide on support projections 240 in order to permit additional extension of silverware baskets 212 from wash chamber 201 of tub 200. The total extension provided by rollers 226 on C-shaped channel 222 and C-shaped channel 222 on support projections 240 may provide full extension of silverware baskets 212 from wash chamber 201 of tub 200, e.g., such that silverware baskets 212 may be completely or at least ninety percent extended from the wash chamber 201 of tub 200 on frame 228.

Brackets 230 also include various features for assisting with mounting brackets 230 to tub 200, e.g., easily and/or quickly. In particular, a threaded projection or post 234 is mounted to each bracket 230. As an example, threaded posts 234 may be integrally mounted to brackets 230 such that threaded posts 234 and brackets 230 are constructed from a single, continuous piece of material, such as molded plastic. Threaded posts 234 extend from brackets 230 through the tub 200. Sleeves 250 are threaded onto threaded posts 234, e.g., outside of wash chamber 201 of tub 200. Thus, sleeves 250 are not disposed within wash chamber 201 of tub 200. Screw threads 236 of threaded post 234 may engage or mesh with screw threads of sleeve 250. Fasteners 260 also extend into threaded post 234, e.g., outside of wash chamber 201 of tub 200. Thus, fasteners 260 are also not disposed within wash chamber 201 of tub 200. Fasteners 260 may be threaded or mounted onto threaded post 234. In particular, screw threads of fasteners 260 may engage or mesh with threaded posts 234.

Rack assembly 210 also includes a seal or gasket (not shown). The gasket is positioned at or on curved outer surface 232 of bracket 230. The gasket assists with hindering or preventing leaks or liquid flow out of wash chamber 201 of tub 200. The gasket is discussed in greater detail below.

Mounting of rack assembly 210 to tub 200 is discussed in greater detail below with reference to FIGS. 3 and 4. To mount rack assembly 210 to tub 200, an assembler can mount slide rail 220 to brackets 230, e.g., such that slide rail 220 is received on support projections 240. The assembler can then position brackets 230 (with slide rail 220 mounted thereto) within wash chamber 201 of tub 200. In addition, the assembler can direct or insert threaded posts 234 through holes defined by tub 200, e.g., until curved outer surfaces 232 of brackets 230 are disposed on or at curved inner surface 206 of tub 200 and screw threads 236 of threaded posts 234 are positioned or disposed outside of wash chamber 201 of tub 200. With threaded posts 234 so positioned, the assembler can hold or support brackets 230 and slide rail 220 within wash chamber 201 of tub 200 and rotate sleeves 250 onto threaded posts 234. In particular, the assembler can rotate sleeves 250 manually or by hand, e.g., utilizing wings 256 of sleeves 250, onto threaded posts 234. With sleeves 250 so positioned, sleeves 250 support brackets 230 and slide rail 220 within wash chamber 201 of tub 200 by preventing or hindering threaded posts 234 from moving back though holes 203 into wash chamber 201 of tub 200. Thus, the assembler can let go of and stop supporting brackets 230 and slide rail 220 within wash chamber 201 of tub 200 due to sleeves 250 supporting such components.

With sleeves 250 supporting brackets 230 and slide rail 220 within wash chamber 201 of tub 200, the assembler fixes fasteners 260 to threaded posts 234. In particular, the assembler can rotate or turn fasteners 260 with a tool or drill in order to thread fasteners 260 into threaded posts 234 with the drill. The assembler can tighten fasteners 260 against sleeves 250 and/or fix fasteners 260 to threaded posts 234 such that brackets 230 are drawn towards tub 200 within wash chamber 201 of tub 200. By drawing brackets 230 towards tub 200, the gasket is compressed between tub 200 and brackets 230, e.g., between curved outer surfaces 232 of brackets 230 and curved inner surface 206 of tub 200. By extending between tub 200 and brackets 230, the gasket can assist with limiting or preventing leaks or liquid flow through or out of the holes in tub 200.

Mounting assembly 214 can assist with mounting slide rail 220 to tub 200 within wash chamber 201 of tub 200, e.g., without welding and/or tox. Mounting assembly 214 can also permit a single installer or assembler to mount slide rail 220 to tub 200 within wash chamber 201 of tub 200. Slide rail 220 can be substantially level when mounted to tub 200.

It should be understood that in alternative exemplary embodiments, posts 234 need not be threaded. Thus, in alternative exemplary embodiments, sleeves 250 can be coupled or engage posts 234 in any suitable manner to hinder or prevent posts 234 from retracting or moving back though holes in tub 200 into wash chamber 201 of tub 200. For example, sleeves 250 may be snap fit over posts 234, double sided tape or adhesive may extend between and couple posts 234 and sleeves 250 together, an interference fit or magnets may couple sleeves 250 to posts 234, etc.

As may be seen in FIGS. 7, 8 and 9, a connecting rail 280 may extend between and connect brackets 230 such that brackets 230 are coupled together with connecting rail 280. Connecting rail 280 may be integrally formed with brackets 230. Thus, brackets 230 and connecting rail 280 may be constructed from a single, continuous piece of material, such as molded plastic. As another example, brackets 230, posts 234 and connecting rail 280 may be constructed from a single, continuous piece of material, such as molded plastic.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance comprising:

a tub defining a wash chamber; and a rack assembly comprising a bracket positioned within the wash chamber of the tub, the bracket having a support projection that defines a plurality of slots;

a post mounted to the bracket, the post extending through an outer surface of the tub;

a sleeve positioned opposite the bracket on the outer surface of the tub, the sleeve engaging the post such that the sleeve hinders the post from retracting through the outer surface of the tub;

a slide rail positioned within the wash chamber and mounted on the support projection of the bracket.

2. The dishwasher appliance of claim 1, wherein a top portion of the tub defines a curved inner surface, the bracket defining a curved outer surface that is complementary to the curved inner surface of the tub, the bracket positioned within the wash chamber such that the curved outer surface of the bracket is positioned at the curved inner surface of the tub.

3. The dishwasher appliance of claim 1, wherein the plurality of slots of the support projection extend vertically on the support projection.

4. The dishwasher appliance of claim 3, wherein each slot of the plurality of slots is sized for permitting food particles to pass through the bracket during operation of the dishwasher appliance.

5. The dishwasher appliance of claim 1, wherein the slide rail comprises a C-shaped channel received on the support projection of the bracket such that the C-shaped channel is slidable on the support projection of the bracket.

6. The dishwasher appliance of claim 5, wherein the rack assembly further comprises a frame and a plurality of rollers mounted to the frame, the plurality of rollers positioned on an outer surface of the C-shaped channel.

7. The dishwasher appliance of claim 6, wherein a top portion of the tub defines a curved inner surface, the frame positioned within the wash chamber of the tub at the top portion of the tub.

8. The dishwasher appliance of claim 1, wherein the sleeve is threaded to the post.

9. The dishwasher appliance of claim 1, wherein the plurality of slots of the support projection comprises at least four slots that are uniformly spaced apart from one another.

10. The dishwasher appliance of claim 1, wherein the bracket and the post are integrally formed of a continuous piece of plastic.

11. A dishwasher appliance comprising:

a tub defining a wash chamber; and a rack assembly comprising a pair of brackets positioned within the wash chamber of the tub, each bracket of the pair of brackets having a support projection that defines a plurality of slots;

a pair of posts extending through an outer surface of the tub, each post of the pair of posts mounted to a respective bracket of the pair of brackets;

a pair of sleeves positioned on the outer surface of the tub, each sleeve of the pair of sleeves positioned opposite a respective bracket of the pair of brackets about the tub, each sleeve of the pair of sleeves engaging a respective post of the pair of post such that each sleeve hinders the respective post from retracting through the tub; and a slide rail positioned within the wash chamber and mounted on the support projection of each bracket of the pair of brackets.

12. The dishwasher appliance of claim 11, wherein a top portion of the tub defines a curved inner surface, each bracket of the pair of brackets defining a curved outer surface that is complementary to the curved inner surface of the tub, the pair of brackets positioned within the wash chamber such that the curved outer surface of each bracket of the pair of brackets is positioned at the curved inner surface of the tub.

13. The dishwasher appliance of claim 11, wherein the plurality of slots of the support projection of each bracket of the pair of brackets extend vertically.

14. The dishwasher appliance of claim 13, wherein each slot of the plurality of slots is sized for permitting food particles to pass through the pair of brackets during operation of the dishwasher appliance.

15. The dishwasher appliance of claim 11, wherein the slide rail comprises a C-shaped channel received on the support projection of each bracket of the pair of brackets such that the C-shaped channel is slidable on the support projection of each bracket of the pair of brackets.

16. The dishwasher appliance of claim 15, wherein the rack assembly further comprises a frame and a plurality of rollers mounted to the frame, the plurality of rollers positioned on an outer surface of the C-shaped channel.

17. The dishwasher appliance of claim 16, wherein a top portion of the tub defines a curved inner surface, the frame positioned within the wash chamber of the tub at the top portion of the tub.

18. The dishwasher appliance of claim 11, wherein the plurality of slots of the support projection of each bracket of the pair of brackets comprises at least four slots that are uniformly spaced apart from one another.

19. The dishwasher appliance of claim 11, further comprising a connecting rail that extends between the brackets of the pair of brackets and couples the brackets of the pair of brackets together.

20. The dishwasher appliance of claim 11, wherein the brackets of the pair of brackets, the posts of the pair of posts and the connecting rail are integrally formed of a continuous piece of plastic.

* * * * *